US007335081B2

(12) United States Patent
Iwaki et al.

(10) Patent No.: US 7,335,081 B2
(45) **Date of Patent: *Feb. 26, 2008**

(54) METHOD FOR MANUFACTURING IMAGE-FORMING APPARATUS INVOLVING CHANGING A POLYMER FILM INTO AN ELECTROCONDUCTIVE FILM

(75) Inventors: Takashi Iwaki, Tokyo (JP); Hironobu Mizuno, Kanagawa (JP); Masaaki Shibata, Kanagawa (JP); Kazuya Miyazaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 629 days.

This patent is subject to a terminal disclaimer.

(21) Appl. No.: 09/941,782

(22) Filed: Aug. 30, 2001

(65) Prior Publication Data

US 2002/0081931 A1 Jun. 27, 2002

(30) Foreign Application Priority Data

Sep. 1, 2000 (JP) ..... 2000-264968

(51) Int. Cl.

| | |
|---|---|
| ***H01J 9/00*** | (2006.01) |
| ***H01J 9/44*** | (2006.01) |
| ***H01J 9/24*** | (2006.01) |
| ***H01J 9/04*** | (2006.01) |
| ***H01J 9/12*** | (2006.01) |

(52) U.S. Cl. ..... 445/6; 445/6; 445/51; 445/50; 313/495; 313/493; 313/497

(58) Field of Classification Search ..... 445/6, 445/24, 49–51, 5, 25; 313/493, 346 R, 495–497, 313/310, 311; 427/77
See application file for complete search history.

(56) References Cited

U.S. PATENT DOCUMENTS 4,093,562 A * 6/1978 Kishimoto ..... 252/511

(Continued)

FOREIGN PATENT DOCUMENTS

CN 1043506 A 7/1990

(Continued)

OTHER PUBLICATIONS

Machine translation of Kamishiro.*

(Continued)

*Primary Examiner*—Nimeshkumar D. Patel
*Assistant Examiner*—Peter Macchiarolo
(74) *Attorney, Agent, or Firm*—Fitzpatrick, Cella, Harper & Scinto

(57) ABSTRACT

The present invention provides a method for manufacturing an electron-emitting device, comprising a step for forming a polymer film between a pair of electrodes formed on a substrate, a step for giving conductivity to the polymer film by heating, and a step for providing potential difference between the pair of electrodes.

27 Claims, 9 Drawing Sheets

U.S. PATENT DOCUMENTS

| | | | | |
|---|---|---|---|---|
| 5,563,644 | A * | 10/1996 | Isganitis et al. | 347/102 |
| 5,674,100 | A * | 10/1997 | Ono et al. | 445/24 |
| 5,749,763 | A * | 5/1998 | Yoshioka et al. | 445/51 |
| 6,002,206 | A | 12/1999 | Harrison et al. | 313/506 |
| 6,113,448 | A * | 9/2000 | Kobayashi et al. | 445/24 |
| 6,169,356 | B1 | 1/2001 | Ohnishi et al. | 313/495 |
| 6,179,678 | B1 | 1/2001 | Kishi et al. | 445/24 |
| 6,184,610 | B1 | 2/2001 | Shibata et al. | 313/309 |
| 6,213,834 | B1 * | 4/2001 | Ohnishi et al. | 445/6 |
| 6,221,426 | B1 * | 4/2001 | Yamanobe | 427/77 |
| 6,246,168 | B1 | 6/2001 | Kishi et al. | 313/495 |
| 6,383,047 | B1 * | 5/2002 | Minami et al. | 445/6 |
| 6,492,769 | B1 * | 12/2002 | Oda et al. | 313/495 |
| 6,783,414 | B2 * | 8/2004 | Minami et al. | 445/6 |
| 6,817,915 | B2 * | 11/2004 | Kyogaku et al. | 445/24 |
| 6,910,935 | B2 * | 6/2005 | Arai et al. | 445/24 |
| 6,960,111 | B2 * | 11/2005 | Takegami et al. | 445/24 |
| 2002/0117670 | A1 | 8/2002 | Horiguchi et al. | 257/59 |
| 2003/0082981 | A1 * | 5/2003 | Takegami et al. | 445/6 |
| 2003/0160180 | A1 * | 8/2003 | Arai et al. | 250/424 |

FOREIGN PATENT DOCUMENTS

| | | | |
|---|---|---|---|
| CN | 1176478 | | 3/1998 |
| EP | 0 693 766 | A1 | 1/1996 |
| EP | 0 788 130 | A2 | 8/1997 |
| EP | 0 986 085 | A2 | 3/2000 |
| EP | 1 184 886 | A1 | 3/2002 |
| JP | 7-235255 | | 9/1995 |
| JP | 08-55563 | | 2/1996 |
| JP | 08-55571 | | 2/1996 |
| JP | A-09-045236 | | 2/1997 |
| JP | 9-106760 | | 4/1997 |
| JP | 09106760 | A * | 4/1997 |
| JP | 9-237571 | | 9/1997 |
| JP | 2903295 | | 3/1999 |
| JP | 11-120901 | | 4/1999 |
| JP | 11-233005 | | 8/1999 |
| JP | 2002-329459 | | 11/2002 |
| KR | 2000-0022939 | | 4/2000 |

OTHER PUBLICATIONS

Public No. 09045236, Patent Abstracts of Japan, Feb. 14, 1997.
Public No. 09106760, Patent Abstracts of Japan, Apr. 22, 1997.
Akiyoshi Baba et al., "Field Emission from an Ion-Beam-Modified Polyimide Film," Japanese Journal of Applied Physics, Publication Board Japanese Journal of Applied Physics, Tokyo, JP, vol. 38 (1999), NR. 3A pp. L261-L263.
PRC Office Action filed Jun. 29, 2007.

* cited by examiner

METHOD FOR MANUFACTURING IMAGE-FORMING APPARATUS INVOLVING CHANGING A POLYMER FILM INTO AN ELECTROCONDUCTIVE FILM

BACKGROUND OF THE INVENTION

1. Field of the Invention

The present invention relates to an electron-emitting device, an electron beam in which a number of electron-emitting elements are arranged, and a method for forming an image-forming apparatus such as a display constituted by using such an electron source. More specifically, the present invention relates to a method for manufacturing an electron emitting-device comprising a substrate, a pair of electrodes formed on the substrate, and a film having a narrow gap and connected between the electrodes.

2. Related Background Art

Conventionally, as electron-emitting devices, two kinds of devices, i.e., a heat electron-emitting device and cold cathode electron-emitting device are known. The cold cathode electron-emitting device is divided into electrical field emitting type, metal/insulator/metal type and surface conduction electron-emitting type.

A construction and manufacturing method for the surface conduction electron-emitting device is disclosed in Japanese Patent Application Laid-open No. 7-235255 and Japanese Patent No. 2903295.

Now, the surface conduction electron-emitting device disclosed in the above documents will be briefly explained.

As shown in a sectional view of FIG. 8, the surface conduction electron-emitting device includes a pair of opposed device electrodes 2, 3 disposed on a substrate 1, and a conductive film 84 connected between the electrode and having an electron-emitting region 85.

The electron-emitting region 85 includes a portion which is formed by fracturing, deforming or deteriorating a part of the conductive film 84 and in which a gap is formed, and deposits 86 mainly including carbon and/or carbon compound are formed on the conductive film within and near the gap by processing called as "activation". Incidentally, the deposits are configured to be opposed to each other with a gap portion narrower than the aforementioned gap.

The activation processing is effected by continuing to apply pulse-shaped voltage to the device for a predetermined time period in an atmosphere including organic substance. In this case, as the shape shown in FIG. 8 is formed, current (device current If) flowing through the device and current (emission current Ie) emitted into vacuum are increased greatly, thereby obtaining a better electron-emitting property.

By using an electron source in which a plurality of the above-mentioned electron-emitting devices are formed and by combining such an electron source with an image-forming member comprised of fluorescent substance, an image-forming apparatus such as a flat display panel can be constituted.

On the other hand, Japanese Patent Application Laid-open No. 9-237571 discloses a method for manufacturing an electron-emitting device, comprising, in place of the activation processing, a step for coating organic material such as thermosetting resin, electron beam negative resist or polyacrylonitrile on a conductive film and a step for effecting carbonizing.

However, in the above-mentioned device, it is inevitable to use a step (called as "forming") for forming a gap by energizing the conductive film, and material and thickness of the conductive film are selected so that the forming can be achieved preferably.

More specifically, in order to reduce an electric power required for the forming and to produce a good gap, it has been proposed to use a fine particle film of palladium oxide as the conductive film.

In addition, since it is difficult to obtain adequate electron emission by means of the gap formed by the forming, there has been a technique in which carbons or carbon compounds are opposed with each other with a narrower gap portion within the gap formed by the forming, by effecting the above-mentioned activation processing or the processing for coating organic polymer film and for effecting energization.

Accordingly, the conventional devices arise the following two problems:

1) When the fine particle film is used as the conductive membrane, it is not always easy to form the thickness and material of the film with high accuracy, and, thus, when a number of electron-emitting devices such as a flat display panel are formed, uniformity may be reduced.
2) Since additional steps such as a step for creating the atmosphere including organic substance and a step for forming polymer film on the conductive film with high accuracy are required for forming the narrower gap portion having good electron-emitting property, management of the steps becomes complicated.

To solve the above problems, there has been requested an electron-emitting device and a method for manufacturing such a device, in which device manufacturing processing can be simplified and an electron-emitting property can be improved.

SUMMARY OF THE INVENTION

An object of the present invention is to provide an electron-emitting device capable of emitting electrons with high efficiency for a long term.

Another object of the present invention is to provide a method for manufacturing an electron-emitting device, in which, in a manufacturing steps, a conventional film forming processing can be simplified and, thus, due to simplification of process, cost can be reduced.

A further object of the present invention is to permit manufacture of an electron source or an image-forming apparatus in which a plurality of electron-emitting devices are arranged, by utilizing the electron emitting device and manufacturing method therefor according to the present invention and to realize an image-forming apparatus in which a high quality image having a large area can be displayed for a long term.

According to the present invention, there is provided a method for manufacturing an electron-emitting device, comprising a step for forming a polymer film between a pair of electrodes formed on a substrate, a step for giving conductivity to the polymer film by heating, and a step for providing potential difference between the pair of electrodes.

Further, according to the present invention, there is provided a method for manufacturing an electron-emitting device, comprising a step for forming a polymer film between a pair of electrodes formed on a substrate, a step for reducing electrical resistance of the polymer film by heating the polymer film, and a step for providing potential difference between the pair of electrodes.

Further, according to the present invention, there is provided a method for manufacturing an electron-emitting device, comprising a step for forming a polymer film between a pair of electrodes formed on a substrate, a step for illuminating an electron beam onto at least a part of the polymer film, and a step for providing potential difference between the pair of electrodes.

Further, according to the present invention, there is provided a method for manufacturing an electron-emitting device, comprising a step for forming a polymer film between a pair of electrodes formed on a substrate, a step for illuminating light onto at least a part of the polymer film, and a step for providing potential difference between the pair of electrodes.

DETAILED DESCRIPTION OF THE PREFERRED EMBODIMENTS

Figure 1A:
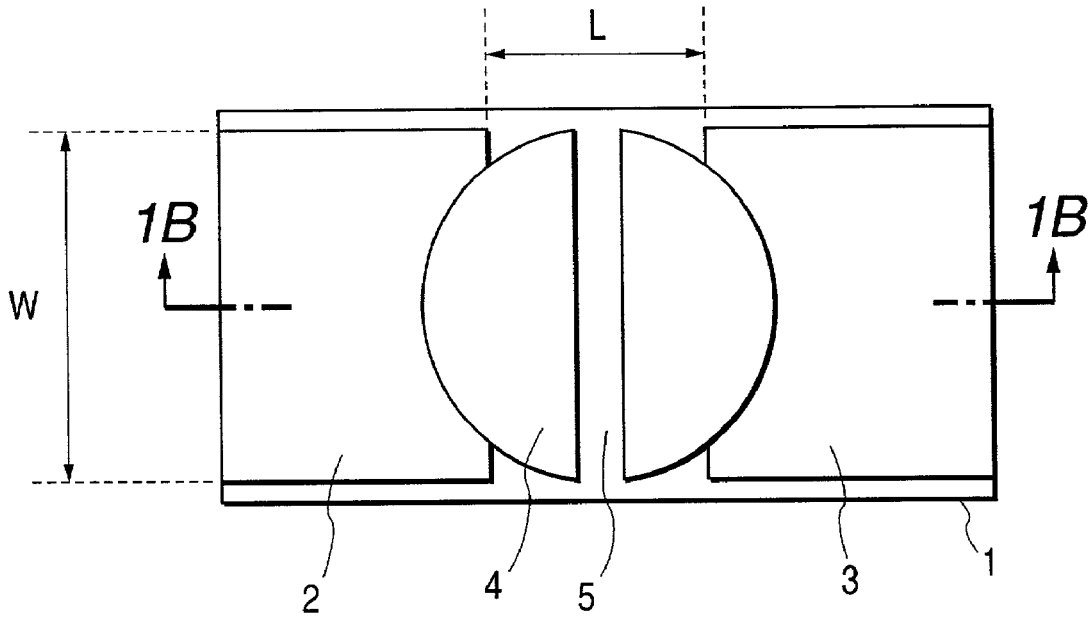
FIG. 1A is a schematic plan view showing an electron-emitting device manufactured by a method according to the present invention.

A first invention relates to a method for manufacturing an electron-emitting device, comprising a step for forming a polymer film between a pair of electrodes formed on a substrate, a step for giving conductivity to the polymer film by heating, and a step for providing potential difference between the pair of electrodes.

Further, in the first invention, the step for giving conductivity to the polymer film by heating may include a step for illuminating an electron beam onto at least a part of the polymer film or a step for illuminating light onto at least a part of the polymer film, and the light may be light emitted from a xenon lamp as a light source or light emitted from a halogen lamp as a light source or laser beam, and the polymer film may be an aromatic polymer film, and the step for forming a polymer film may utilize an ink jet system.

A second invention relates to a method for manufacturing an electron-emitting device, comprising a step for forming a polymer film between a pair of electrodes formed on a substrate, a step for reducing electrical resistance of the polymer film by heating the polymer film, and a step for providing potential difference between the pair of electrodes.

Further, in the second invention, the step for reducing electrical resistance of the polymer film by heating the polymer film may include a step for illuminating an electron beam onto at least a part of the polymer film or a step for illuminating light onto at least a part of the polymer film, and the light may be light emitted from a xenon lamp as a light source or light emitted from a halogen lamp as a light source or laser beam, and the step for forming a polymer film may utilize an ink jet system.

A third invention relates to a method for manufacturing an electron-emitting device, comprising a step for forming a polymer film between a pair of electrodes formed on a substrate, a step for illuminating an electron beam onto at least a part of the polymer film, and a step for providing potential difference between the pair of electrodes.

Further, in the third invention, the step for illuminating an electron beam onto the polymer film may include a step for giving conductivity to at least a part of the polymer film or a step for reducing electrical resistance of the polymer film, and the polymer film may be an aromatic polymer film, and the step for forming a polymer film may utilize an ink jet system.

A fourth invention relates to a method for manufacturing an electron-emitting device, comprising a step for forming a polymer film between a pair of electrodes formed on a substrate, a step for illuminating light onto at least a part of the polymer film, and a step for providing potential difference between the pair of electrodes.

Further, in the fourth invention, the step for illuminating light onto the polymer film may include a step for giving conductivity to at least a part of the polymer film or a step for reducing electrical resistance of the polymer film, and the light may be light emitted from a xenon lamp as a light source or light emitted from a halogen lamp as a light source or laser beam, and the polymer film may be an aromatic polymer film, and the step for forming a polymer film may utilize an ink jet system.

A fifth invention relates to a method for manufacturing an electron source having a plurality of electron-emitting devices, wherein the electron-emitting device is manufactured in accordance with any one of the first to fourth inventions.

A sixth invention relates to a method for manufacturing an image-forming apparatus having an electron source including a plurality of electron-emitting devices, and an image-forming member for forming an image by illumination of electron emitted from the electron source, wherein the electron source is manufactured by the above-mentioned manufacturing method.

The polymer in the present invention means polymer including coupling between carbon atoms.

When heat is applied to the polymer including coupling between carbon atoms, the coupling between carbon atoms is dissociated and re-coupled, thereby producing conductivity. The polymer having conductivity in this way is called as "pyrolytic polymer".

Although the "pyrolytic polymer" in the present invention means the polymer to which the conductivity is given by application of heat, polymer obtained by factors other than heat, for example, polymer obtained by dissociation/re-coupling by an electron beam or dissociation/re-coupling by photon in addition to dissociation/re-coupling by heat is also referred to as pyrolytic polymer.

In the pyrolytic polymer, it can be interpreted that the conductivity is increased by increasing conjugate double bond between the carbon atoms in the original polymer, and the conductivity is differentiated in dependence upon the degree of progress of pyrolysis.

Further, as polymer in which the conductivity is apt to be produced by the dissociation/re-coupling between the carbon atoms, i.e., double bond between the carbon atoms is apt to be produced, aromatic polymer is known. Particularly, aromatic polyimide is polymer in which pyrolytic polymer having high conductivity can be achieved at a relatively low temperature.

In general, although the aromatic polyimide is insulator itself, there are polymers having conductivity prior to pyrolysis, such as polyphenylene oxyadiazol and polyphenylene vinylene. Since these polymers further increase the conductivity by the pyrolysis to reduce electrical resistance, they can be used in the present invention preferably.

According to the present invention, the electron-emitting device can be formed by the step for forming the polymer film, step for effecting pyrolysis and step for forming a gap by energization, and, thus, the manufacturing method can be simplified in comparison with the conventional method including a step for forming a conductive film, step for effecting forming, step for producing an atmosphere including organic substance (or step for forming a polymer film on the conductive film) and step for forming a gap portion between carbons or carbon compounds by energization. Further, since the pyrolytic polymer is changed to harder carbon material by application of heat, a heat resisting ability is also improved. Accordingly, an electron-emitting property which was conventionally limited by performance of the conductive film can be enhanced.

Figure 1B:
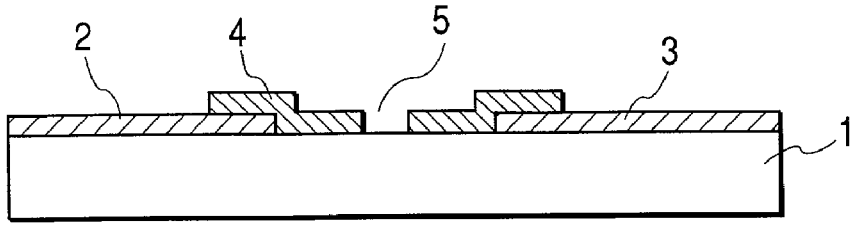
FIG. 1B is a sectional view along line 1B—1B in FIG. 1A.

FIGS. 1A and 1B are schematic views showing a construction of the electron-emitting device according to the present invention, where FIG. 1A is a plan view and FIG. 1B is a sectional view along line 1B-1B in FIG. 1A.

In FIGS. 1A and 1B, the device includes a substrate 1, device electrodes 2, 3, polymer films 4 and a gap 5. Incidentally, in the present invention, the polymer film 4 may also be referred to as a "pyrolytic polymer film" since it includes pyrolytic polymer which will be described later. Further, in the present invention, the "polymer film" and the "pyrolytic polymer film" and "film mainly including carbon" have the same meaning. Further, the films 4 mainly including carbon are disposed on the substrate 1 between the device electrodes 2, 3 and on the device electrodes. Incidentally, in FIG. 1, although the films 4 mainly including carbon is schematically shown to be laterally opposed to each other on the substrate and be separated from each other by the gap 5, they may be partially interconnected. Namely, an aspect in which a gap is formed in a part of the film mainly including carbon electrically connecting between the pair of electrodes can be adopted. Further, the polymer film 4 according to the present invention mainly includes carbon and also includes nitrogen. Further, it may include hydrogen or boron, and, furthermore, it may include metal such as silver. In the film mainly including carbon, it is important that contents (ratio of respective atoms to carbon atoms) of components other than carbon be more reduced in areas adjacent to the gap 5 than in areas adjacent to the electrodes 2, 3.

A glass substrate can be used as the substrate 1. Material of the opposed device electrodes 2, 3 may be normal conductive material, namely, film of metallic material or oxide conductor.

As mentioned above, the polymer film 4 is a polymer having the coupling between the carbon atoms.

The gap 5 is fissure-like gap formed in the polymer film 4 and is a region where tunnel of electrons is generated upon application of an adequate electrical field to produce current, and a part of tunnel electrons becomes emitted electrons by scattering.

Accordingly, it is desirable that conductivity is given to at least a part of the polymer film 4. The reason is that, if the polymer film 4 is insulative, even when potential difference is provided between the device electrodes 2 and 3, the electrical field is not applied to the gap 5 thereby not to emit the electrons. Preferably, at least so long as an area to which the conductivity is given exists to connect the device electrode 2 (and the device electrode 3) and the gap 5, the adequate electrical field can be applied to the gap 5.

Figure 2A:
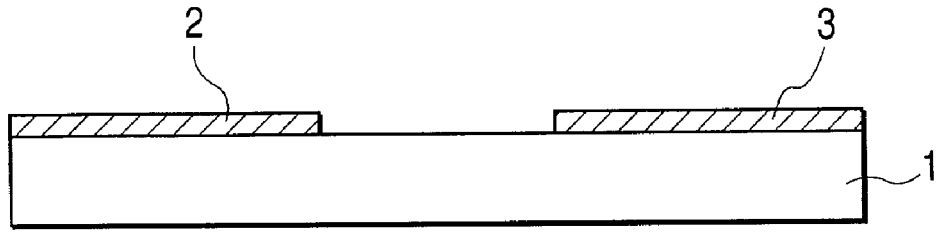
FIGS. 2A, 2B and 2C are schematic sectional views showing an example of a manufacturing method for a surface conduction electron-emitting device of the present invention.
Figure 2B:
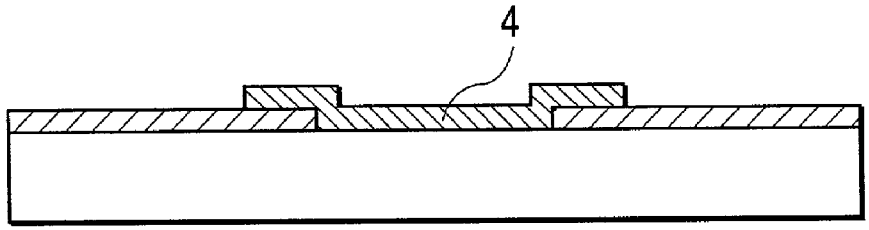
Figure 2C:
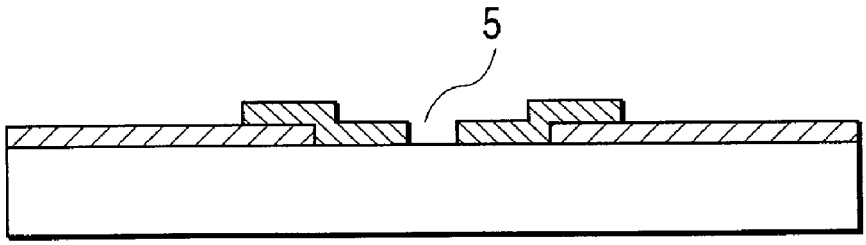

FIGS. 2A to 2C show an example of a method for manufacturing the electron-emitting device in the present invention. Now, such as example of a method for manufacturing the electron-emitting device will be explained with reference to FIGS. 1A and 1B and FIGS. 2A to 2C.

(1) The substrate 1 is fully cleaned by using detergent, pure water, organic solvent and the like. Then, after device electrode material is deposited on the substrate by vacuum evaporation, spattering or the like, the device electrodes 2, 3 are formed on the substrate 1, for example, by using a photolithography technique (FIG. 2A). Here, although noble metal such as platinum is preferably used as the device electrode material, as will be described later, if a laser illuminating process is performed, a film of oxide conductor as transparent conductor such as tin oxide or indium oxide (ITO) may be used, if necessary.

(2) The polymer film 4 is formed between the device electrodes 2 and 3 on the substrate 1 on which the device electrodes 2, 3 were formed (FIG. 2B).

As a method for forming the polymer film 4, one of various well-known methods such as a rotary coating method, a printing method or a dipping method can be used. Particularly, the printing method is preferable since a desired configuration of the polymer film 4 can be formed without using patterning means. Among them, a printing method of ink jet type is effective to the manufacture of an electron source in which the electron-emitting devices are arranged with high density and which can be applied to a flat display panel, because minute configuration smaller than several hundreds of μm can be formed directly.

When the polymer film 4 is formed by the ink jet system, the solution of polymer material is applied as liquid droplets and then is dried into a solid state polymer film. If necessary, the solution of a desired precursor polymer may be applied as liquid droplets and then be polymerized by heating.

In the present invention, although aromatic polymer is preferably used as the polymer material, since the aromatic polymer is often hard to be solved in solvent, it is effectively to use a method for coating precursor previously. As an example, polyamic acid solution as precursor for aromatic polyimide is coated (applied as droplets) by the ink jet system and a polyimide film is formed by heating.

Incidentally, as solvent for solving the precursor for polymer, for example, N-methyl pyrrolidone, N,N-dimethyl acetoamide, N,N-dimethyl formaldehyde or dimethyl sulfoxide may be used, and, n-butyl Cellosolve or triethanol amine may be added. However, so long as the solvent can be applied to the present invention, the solvent is not limited to the above-mentioned one.

(3) Then, the polymer film 4 is subjected to a pyrolysis operation to form the pyrolytic polymer. The pyrolysis operation is processing for producing conductivity by effecting dissociation/re-coupling of the coupling between the carbon atoms in the polymer.

The method for forming the conductive pyrolytic polymer can be achieved by heating the specific polymer up to a temperature greater than a decomposition temperature under an environment (for example, under inert gas environment or under vacuum) which does not occur oxidation.

As mentioned above, although the aromatic polymer, particularly, aromatic polyimide has a high pyrolytic temperature as polymer, by heating at a temperature exceeding the pyrolytic temperature, typically, at a temperature of 700° C. to 800° C. or more, the pyrolytic polymer having high conductivity can be obtained.

However, as is in the present invention, when the pyrolytic polymer is used as material for constituting the electron-emitting device, a method for heating the polymer entirely by an oven or a hot plate may be subjected to limitation in the viewpoint of heat-resistivity of other constructural members.

Particularly, regarding the substrate, it is limited to a substrate having particularly high heat-resistivity such as quarts glass substrate or a ceramic substrate, and, when it is considered to apply the substrate to a large area display panel, it becomes very expensive.

Thus, in the present invention, as more preferable means for effecting pyrolysis operation, illumination of electron beam or illumination of light is used, and the light illumination utilizes light emitted from a xenon lamp or a halogen lamp as a light source or a laser beam. By such electron beam illumination or the light illumination, the polymer film 4 is locally heated, thereby obtaining the pyrolytic polymer without using an expensive substrate having high heat-resistivity. In this case, factors other than heat, for example, dissociation/re-coupling by using electron beam or dissociation/re-coupling by using photon may be added to the dissociation/re-coupling by using the heat.

Now, the actual pyrolysis operation will be explained.

(When Electron Beam Illumination is Effected)

When the electron beam is illuminated, the substrate 1 on which the device electrodes 2, 3 and the polymer film 4 were formed is set in a vacuum container to which an electronic gun is mounted. The pyrolysis operation is effected by illuminating the electron beam from the electronic gun onto the polymer film 4. In this case, an illuminating condition for the electron beam is preferably, for example, acceleration voltage Vac greater than 0.5 kV and smaller than 10 kV and current density ρ greater than 0.01 $mA/mm^2$ and smaller than 1 $mA/mm^2$. Further, in this case, by monitoring a resistance value between the device electrodes 2, 3, the illumination can be finished when a desired resistance value is obtained.

(When Laser Beam Illumination is Effected)

When the laser beam is illuminated, the substrate 1 on which the device electrodes 2, 3 and the polymer film 4 were formed is set on a stage, and the pyrolysis operation is effected by illuminating the laser beam onto the polymer film 4. In this case, although it is preferable that the laser is illuminated under inert gas environment or under vacuum in order to prevent oxidation (burning) of the polymer film 4, the laser beam illumination may be effected under an atmosphere, depending upon the laser illumination condition.

The laser beam illumination condition can be selected appropriately. For example, the laser illumination is effected by using second high harmonic wave (having a wavelength of 632 mm) of a pulse YAG laser, and, by monitoring a resistance value between the device electrodes 2, 3, the illumination can be finished when a desired resistance value is obtained.

Incidentally, by selecting constructural materials so that optical absorbed wavelengths of the polymer film 4 and the device electrodes 2, 3 are differentiated and by illuminating a laser beam having a wavelength coinciding with the absorbed wavelength of the polymer film 4, only the polymer film 4 can substantially be heated. Thus, this is more preferable.

(When Illumination Other than Laser is Effected)

When light other than laser is illuminated, the substrate 1 on which the device electrodes 2, 3 and the polymer film 4 were formed is set on a stage, and the light is illuminated onto the polymer film 4 and therearound. In this case, although it is preferable that the light is illuminated under inert gas environment or under vacuum in order to prevent oxidation (burning) of the polymer film 4, the laser beam illumination may be effected under an atmosphere, depending upon the laser illumination condition.

A xenon lamp or a halogen lamp is used as a light source, and, by collecting the light by light collecting means to effect local light illumination, it is possible to heat the polymer film up to a temperature greater than 800° C. required for achieving the pyrolytic temperature of the polymer film.

The xenon light includes from visual light to infrared light substantially continuously and particularly has plural abrupt peak intensities in a wavelength band in near-infrared zone in the vicinity of wavelength of 1 μm; whereas, the halogen light mainly includes visual light. Accordingly, it is preferable that the light source is selected in accordance with the material of the polymer film or the electrode.

The illuminated light acts to increase the temperature of the polymer film by directly absorbing the light by the polymer film, and, in some cases, acts to warm the electrodes by the light illuminated onto the electrodes near the polymer film, thereby heating the polymer film through heat conduction. Preference of these actions is determined by materials of the electrodes and of the polymer film.

Incidentally, depending upon material of the substrate, the substrate may be thermally deformed. To avoid this, by pulse-modulating the light, excessive heating of the substrate can be suppressed. A condition for the pulse modulation can be set appropriately in accordance with a heat amount generated, heat conductivity of the substrate and a heat radiating amount. Incidentally, the pulse modulation is also effective to the above-mentioned laser beam illumination for the same reason.

Further, regarding the light to be illuminated, by selecting the light absorbing ability of the material constituting the polymer film 4 to be greater than the light absorbing ability of the material constituting the electrodes 2, 3, it is more preferable that substantially only the polymer film 4 is heated.

Further, it is preferable that a resistance value between the electrodes 2 and 3 is monitored and the light illumination is finished when a desired resistance value is obtained.

Since the light heating can perform light illumination onto a greater area at once relatively easily by widening a light collecting area, the polymer film can be heated effectively even in a large area such as a panel.

As mentioned above, although the polymer film 4 change changed to the pyrolytic polymer by the electron beam illumination or the light illuminating utilizing the light emitted from the xenon lamp or the halogen lamp as the light source or the laser beam, it is not necessary that the entire polymer film 4 must be subjected to pyrolysis. Even when only a part of the polymer film 4 is subjected to pyrolysis, the following step can be performed.

(4) Then, the gap 5 constituting the electron-emitting region is formed in the polymer film 4 subjected to pyrolysis (FIG. 2C).

The formation of the gap 5 is achieved by applying voltage (flowing current) between the device electrodes 2 and 3. Incidentally, preferably, voltage to be applied is pulse voltage. By such voltage applying process (energization operation), a part of the polymer film 4 is locally fractured, deformed or deteriorated to change a structure thereof, thereby forming the gap 5.

Incidentally, the energization operation can also be performed by continuously applying voltage pulses between the device electrodes 2 and 3, simultaneously with the pyrolysis operation, i.e., while the electron beam illumination or the light illumination is being effected. In any cases, it is desirable that this process is performed under a depressurized atmospheric condition, and, preferably, under an atmosphere having pressure smaller than $1.3\times10^{-3}$ Pa.

In the energization operation in this process, by applying the voltage pulses, current corresponding to a resistance value of the polymer film 4 flows. Accordingly, if the polymer film 4 has extremely low resistance, i.e., if the polymer film is a film well subjected to pyrolysis, the energization operation in this process requires great electric power. In order to perform the energization operation with relatively small energy, the degree of progress of the pyrolysis may be adjusted or only a part of the polymer film 4 may be subjected to pyrolysis.

When it is considered that the electron-emitting device according to the present invention is driven under the vacuum, it is not preferable that insulator is exposed under the vacuum. Thus, it is preferable that the electron beam illumination or the light illumination utilizing the light emitted from the xenon lamp or the halogen lamp as the light source or the laser beam reforms substantially the entire surface of the polymer film (applies conductivity).

Figure 3A:
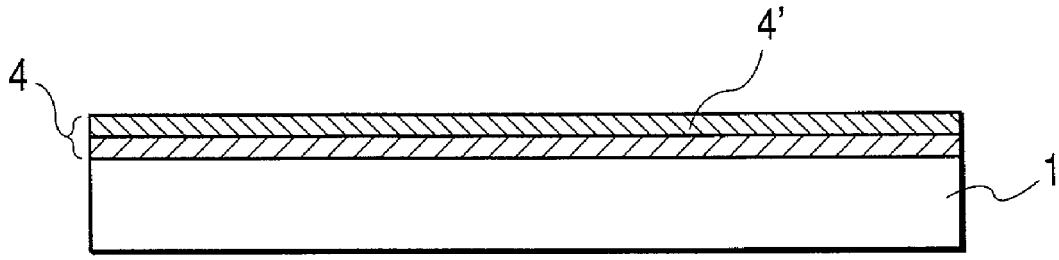
FIGS. 3A, 3B and 3C are schematic sectional views showing another example of an electron-emitting device manufactured by the method according to the present invention.
Figure 3B:
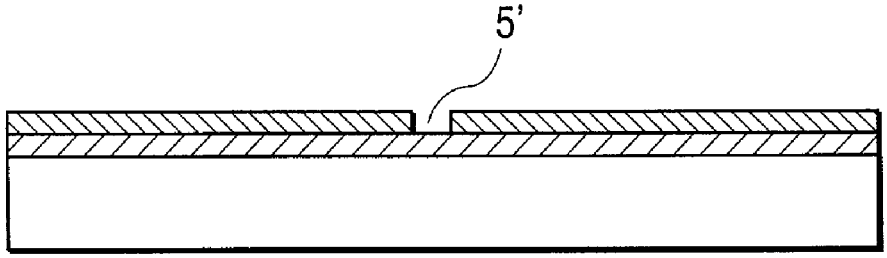
Figure 3C:
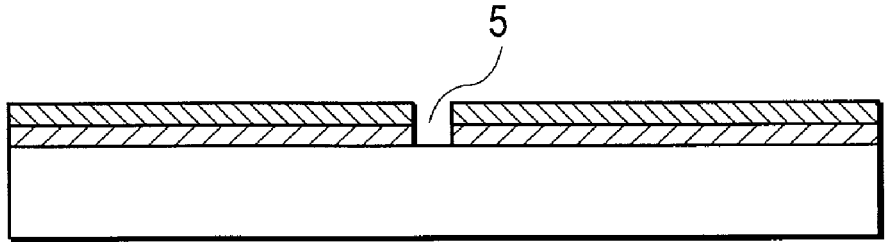

FIGS. 3A to 3C are schematic (sectional) views showing the polymer film 4 the surface of which is changed to pyroplytic polymer, where FIG. 3A shows a condition prior to the energization operation, FIG. 3B shows a condition immediately after the energization operation is started, and FIG. 3C shows a condition after the energization operation is finished.

First of all, a surface area 4' of the polymer film 4 subjected to pyrolysis is subjected to the energization operation, thereby forming a gap 5' (FIG. 3B). While the electrons tunneled through the formed gap 5' and are scattered against the opposed surface of the film surfaces of the pyrolytic polymer to emit the electrons, an underlying polymer area which has not yet been subjected to pyrolysis is gradually subjected to pyrolysis, and, ultimately, the gap 5 is formed through the whole thickness of the polymer membrane 4 (FIG. 3C).

Incidentally, even when the area of the pyrolytic polymer is at a side adjacent to the substrate or at an intermediate zone of the thickness of the film, the gap 5 is formed through the whole thickness of the polymer film 4 ultimately.

Figure 4A:
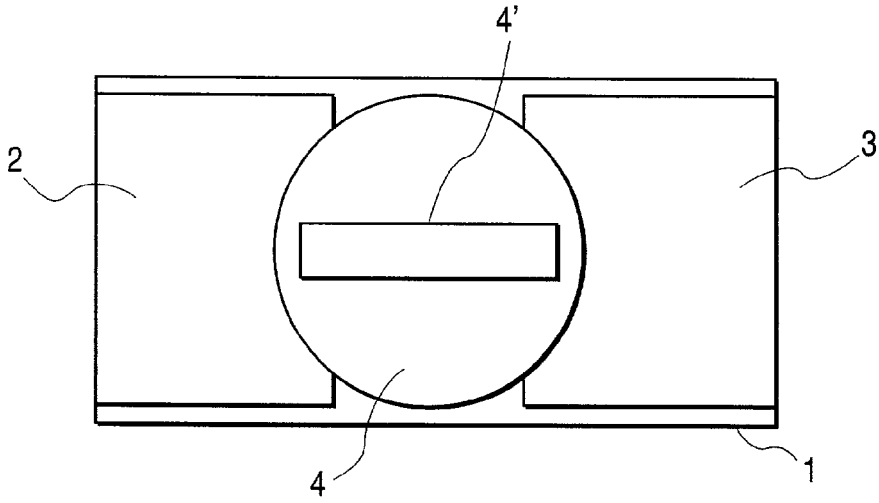
FIGS. 4A, 4B and 4C are schematic sectional views showing a further example of an electron-emitting device manufactured by the method according to the present invention.
Figure 4B:
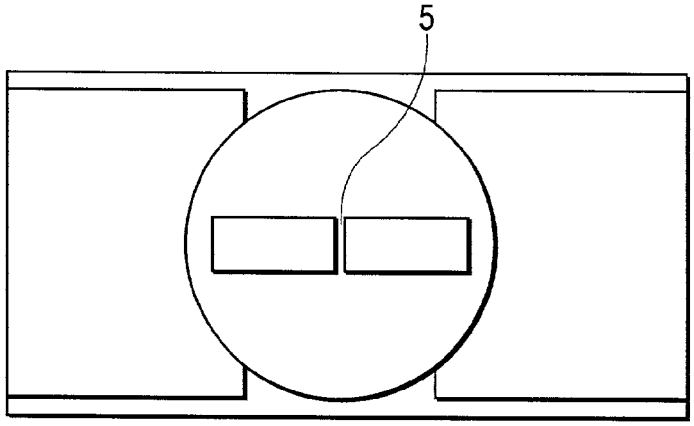
Figure 4C:
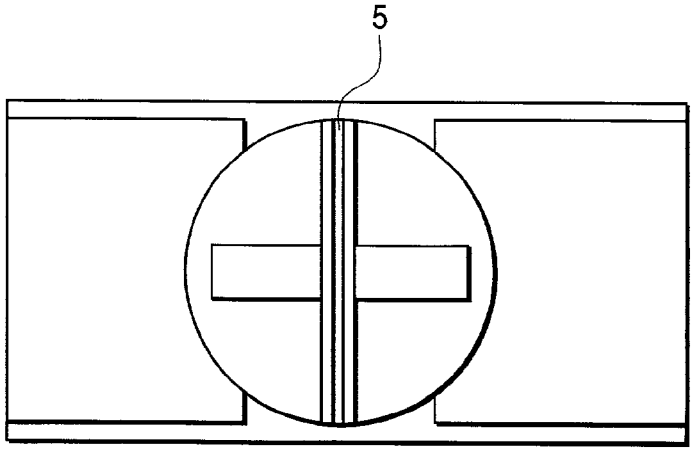

FIGS. 4A to 4C are schematic (plan) views showing the polymer membrane 4 a part of which is changed to the pyrolytic polymer in a direction parallel to the surface of the substrate, where FIG. 4A shows a condition prior to the energization operation, FIG. 4B shows a condition immediately after the energization operation is started, and FIG. 4C shows a condition after the energization operation is finished.

Figure 2D:
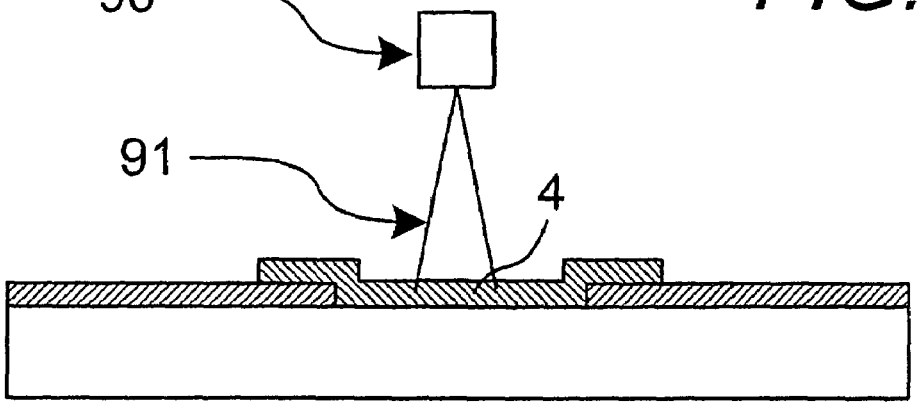
FIG. 2D represents a light or other illumination source 90 illuminating an electron-emitting device precursor during the manufacturing method.

First of-all, a surface area 4' of the polymer film 4 subjected to pyrolysis is subjected to the energization operation, thereby forming a gap 5' (FIG. 3B). While the electrons tunneled through the formed gap 5' and are scattered against the opposed surface of the film surfaces of the pyrolytic polymer to emit the electrons, an underlying polymer area which has not yet been subjected to pyrolysis is gradually subjected to pyrolysis, and, ultimately, the gap 5 is formed through the whole thickness of the polymer membrane 4 (FIG. 3C). FIG. 2D represents a light or other illumination source 90 providing illumination 91 (e.g., light, a laser beam, or electron beam) to a film 4.

Incidentally, as mentioned above, in many cases, when the polymer film 4 partially subjected to pyrolysis is used, good electron emitting property can be obtained. Although the reason is not clear, it is guessed that, since the polymer not subjected to pyrolysis is apt to be shifted toward the vicinity of the gap 5 by heat diffusion, the gap more suitable for electron emission is formed and held, thereby providing a structure which is hard to be deteriorated by the driving.

Figure 9:
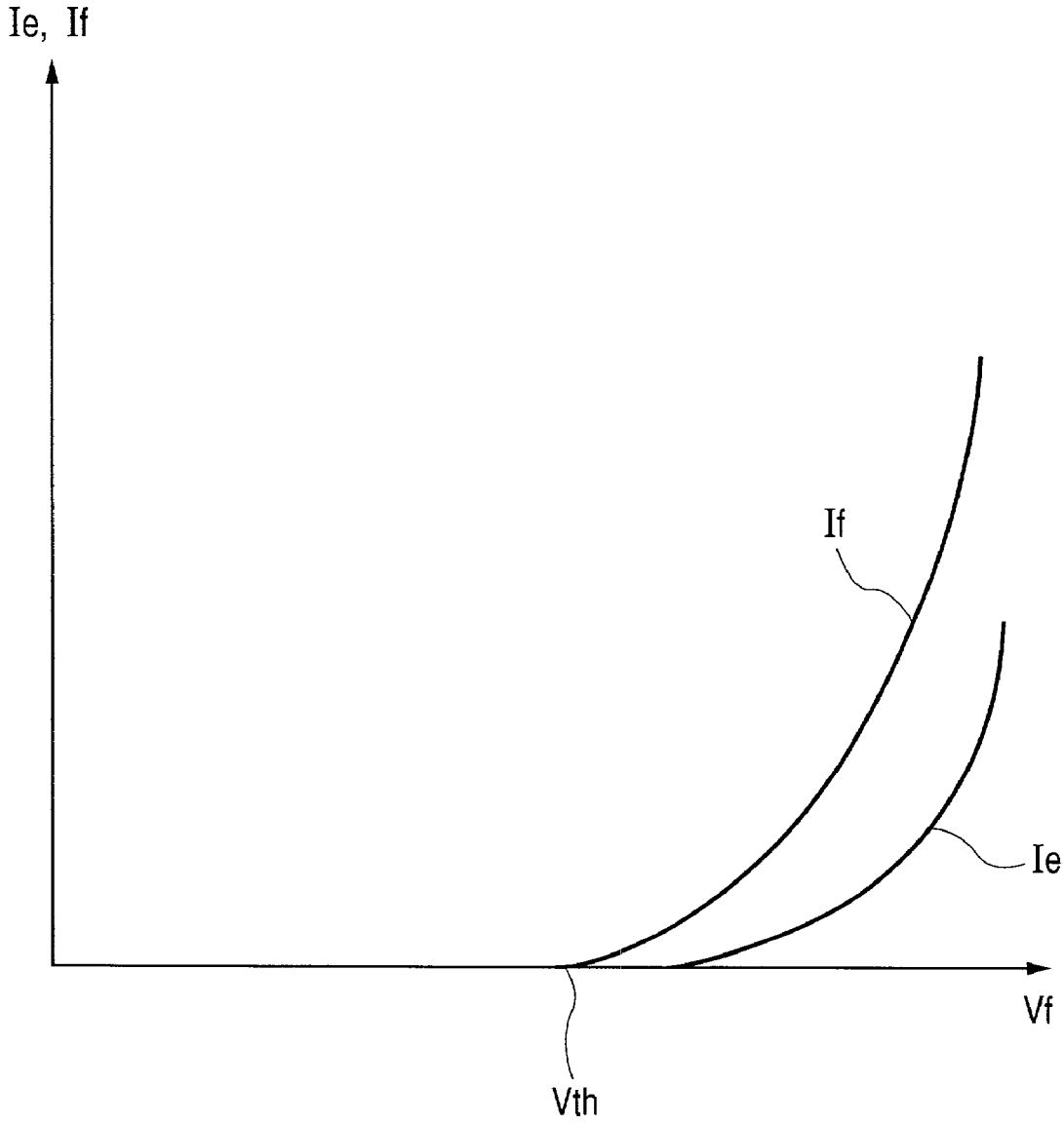
FIG. 9 is a schematic graph showing an electron-emitting property of the electron-emitting device manufactured by the method according to the present invention.

As shown in FIG. 9, the electron-emitting device obtained by the above-mentioned processes has a threshold voltage Vth, so that, although the electrons are not substantially emitted if voltage smaller than the threshold voltage is applied between the electrodes 2 and 3, when voltage greater than the threshold voltage is applied, emission current (Ie) from the device and device current (If) flowing between the electrodes 2 and 3 start to be generated.

Due to such a property, an electron source in which a plurality of electron-emitting devices according to the present invention are arranged on the same substrate in a matrix pattern can be formed, and passive matrix driving for selectively driving the desired device(s) can be achieved.

Accordingly, by forming the electron source by using the electron-emitting devices of the present invention and by combining the electron source with an image-forming member, for example, an image-forming apparatus such as a flat panel display having a large picture plane can be formed.

[Embodiments]

Although embodiments of the present invention will now be described, the present invention is not limited to such embodiments.

[Embodiment 1]

As the electron-emitting device according to an embodiment 1, the electron-emitting device of type shown in FIGS. 1A and 1B was formed by using a method similar to the manufacturing method shown in FIGS. 2A to 2C. Now, the method for manufacturing the electron-emitting device according to the embodiment 1 will be described with reference to FIGS. 1A and 1B and FIGS. 2A to 2C.

A quartz glass substrate was used as the substrate 1, and the substrate 1 was fully cleaned by using pure water, organic solvent and the like. Thereafter, the device electrodes 2, 3 made of platinum were formed on the substrate 1 (FIG. 2A). In this case, a distance L between the device electrodes was selected to 10 μm, a width of the device electrode was selected to 500 μm and a thickness of the device electrode was selected to 100 μm.

Then, polyamic acid solution (PIX-L110; manufactured by Hitachi Kasei Co., Ltd.) as precursor for aromatic polyimide and solution diluted by N-methyl pyrrolidone/triethanol amine solvent up to resin ratio of 3% were rotary-coated on the substrate manufactured in this way by means of a spin-coater. Then, a temperature was increased up to 350° C. under vacuum to effect baking, thereby obtaining polyimide. In this case, a film thickness of polyimide was selected to 30 nm.

The polyimide film was patterned to form a square configuration of 300 μm×300 μm straddling between the device electrodes 2 and 3 by a photolithography technique, thereby forming the polymer film having a desired configuration (FIG. 2B).

Then, the substrate 1 on which the device electrodes 2, 3 and the polymer film 4 were formed was set in a vacuum container to which an electronic gun was mounted and adequate air discharge was performed. Thereafter, electron beam having acceleration voltage Vac of 10 kV and current density ρ of 0.1 mA/mm$^2$ was illuminated onto the whole surface of the polymer film 4. In this case, resistance between the device electrodes 2 and 3 was measured, and the electron beam illumination was stopped when the resistance was reduced to 1 kΩ.

Figure 5:
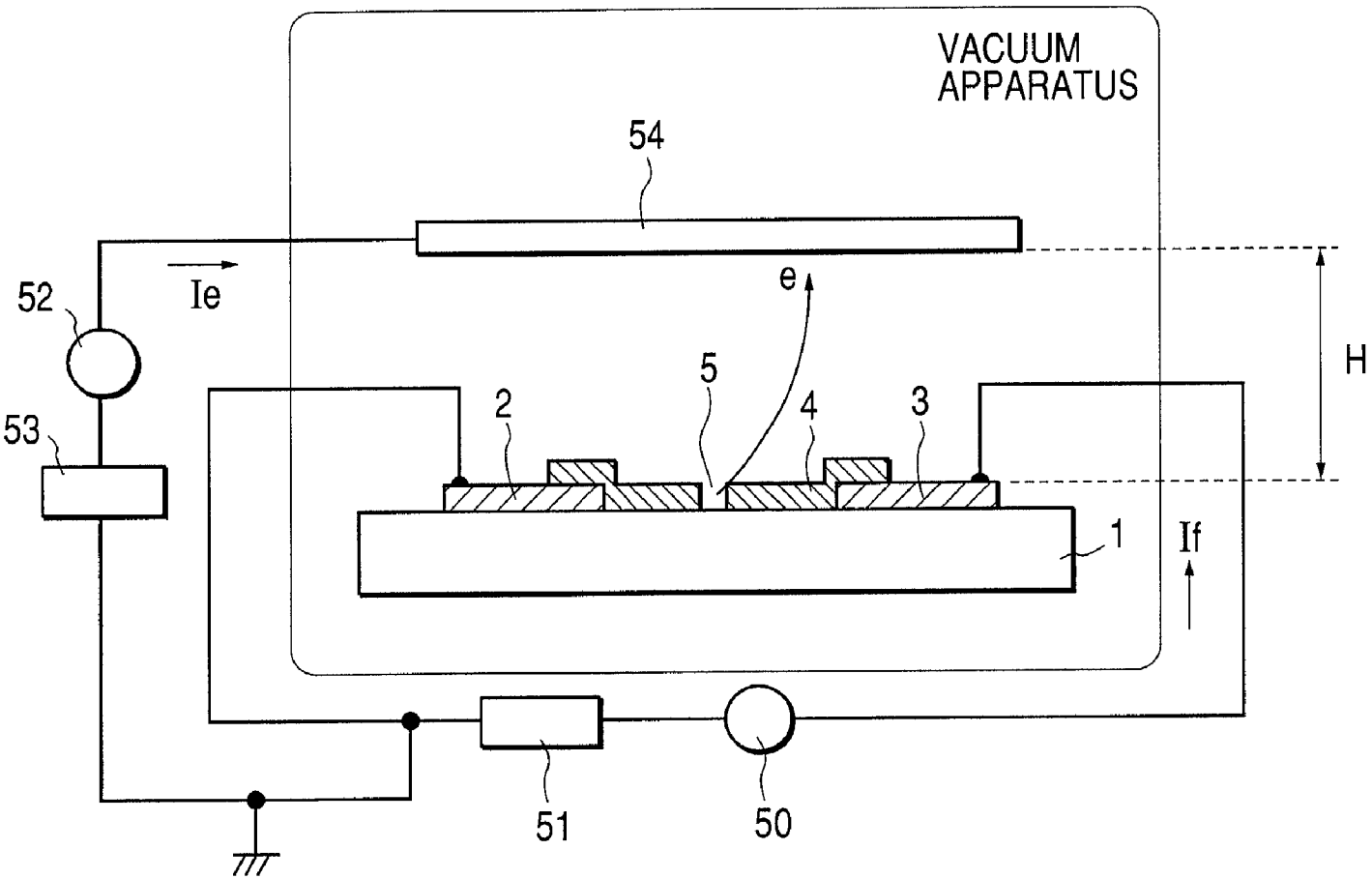
FIG. 5 is a schematic view showing an example of a vacuum device having a measurement evaluating function.

Then, the substrate 1 on which the device electrodes 2, 3 and the polymer film 4 subjected to the electron beam illumination were formed was transferred into a vacuum device shown in FIG. 5.

Here, in FIG. 5, the reference numeral 51 denotes a power supply for applying the voltage to the device; 50 denotes an ammeter for measuring the device current If; 54 denotes an anode electrode for measuring the emission current Ie generated by the device; 53 denotes a high voltage power supply for applying voltage to the anode electrode 54; and 52 denotes an ammeter for measuring the emission current. In the measurement of the device current If and the emission current Ie of the electron-emitting device, the power supply 51 and the ammeter 50 are connected to the device electrodes 2, 3 and the anode electrode 54 to which the power supply 53 and the ammeter 52 are connected is disposed above the electron-emitting device. Further, the electron-emitting device and the anode electrode 54 are installed in a vacuum device which includes a discharge pump (not shown) and a vacuum gauge (not shown) required for the vacuum device so that evaluation of the electron-emitting device can be measured under desired vacuum. Incidentally, a distance H between the anode electrode and the electron-emitting device was selected to 4 mm and pressure in the vacuum device was selected to $1\times10^{-6}$ Pa.

By using the system shown in FIG. 5, the gap 5 was formed in the polymer film 4 by applying bipolar rectangular pulses having voltage of 2.5 V, pulse width of 1 msec and pulse interval of 10 msec.

By the above-mentioned steps, the electron-emitting device of the embodiment 1 was manufactured.

Then, when the drive voltage of 22 V was applied between the device electrodes 2 and 3 of the electron-emitting device of the embodiment 1 while applying voltage of 1 kV to the anode electrode 54 in the vacuum device of FIG. 5, it was found that If was 0.6 mA and Ie was 4.2 μA and that the stable electron-emitting property was maintained for a long term.

Lastly, when the electron-emitting device of the embodiment 1 was cut and a cut section near the gap 5 was observed by an electronic microscope of permeable type (TEM), it was found configuration similar to those shown in FIGS. 1B and 3C was ascertained.

[Embodiment 2]

The electron-emitting device according to an embodiment 2 fundamentally has a configuration similar to that of the electron-emitting device of the embodiment 1.

Similar to the embodiment 1, N-methyl pyrrolidone/n-butyl Cellosolve solution of 3% of polyphenylenen hydrazide as precursor for polyphenylene oxisadiazol was rotary-coated on the quartz glass substrate on which the device electrodes 2, 3 formed from platinum were formed, manufactured in this way by means of a spin-coater. Then, a temperature was increased up to 310° C. under vacuum to effect baking, thereby obtaining polyphenylene oxisadiazol film having a thickness of 30 nm.

The polyphenylene oxisadiazol film was patterned to form a square configuration of 300 μm×300 μm straddling between the device electrodes 2 and 3 by a photolithography technique, thereby forming the polymer film having a desired configuration.

Then, after the electron beam was illuminated on the entire surface of the polymer film 4 under the same condition as the embodiment 1, the substrate was transferred into the vacuum device shown in FIG. 5.

Further, similar to the embodiment 1, by using the system of FIG. 5 and by applying bipolar rectangular pulses having voltage of 22 V, pulse width of 1 msec and pulse interval of 10 msec between the device electrodes 2 and 3, the gap 5 is formed in the polymer film 4, thereby forming the electron-emitting device of the embodiment 2.

Then, when the drive voltage of 20 V was applied between the device electrodes 2 and 3 of the electron-emitting device of the embodiment 2 while applying anode voltage of 1 kV in the vacuum device of FIG. 5 and the device current If and the emission current Ie flowing at this time were measured, it was found that If was 018 mA and Ie was 3.5 μA and that the stable electron-emitting property was maintained for a long term.

Lastly, when the electron-emitting device of the embodiment 2 was cut and a cut section near the gap 5 was observed by an electronic microscope of permeable type (TEM), it was found configuration similar to those shown in FIGS. 1B and 3C was ascertained.

[Embodiment 3]

The electron-emitting device according to an embodiment 3 fundamentally has a configuration similar to that of the electron-emitting devices of the embodiments 1 and 2.

Similar to the embodiment 1, the quartz glass substrate 1 on which the device electrodes 2, 3 comprised of platinum and the polymer film 4 comprised of polyimide film were formed was set in a vacuum container to which an electronic gun was mounted and adequate air discharge was performed. Thereafter, bipolar rectangular pulses having voltage of 25 V, pulse width of 1 msec and pulse interval of 10 msec were applied between the device electrodes 2 and 3 while illuminating electron beam having acceleration voltage Vac of 7 kV and current density ρ of 0.1 mA/mm$^2$ onto the whole surface of the polymer film 4. In this case, the current flowing between the device electrodes 2 and 3 was gradually increased, and, after the current was increased up to about 2.5 mA, since the current was suddenly decreased, the electron beam illumination was stopped.

Then, when the device was picked up and was cut and a cut section near the gap 5 was observed by an electronic microscope of permeable type (TEM), it was found configuration similar to that shown in FIG. 3B was ascertained.

Further, by using the system of FIG. 5, bipolar rectangular pulses having voltage of 25 V, pulse width of 1 msec and pulse interval of 10 msec were applied again between the device electrodes 2 and 3 of a device similarly formed.

Through the above processes, the electron-emitting device of the embodiment 3 was manufactured.

Then, when the drive voltage of 22 V was applied between the device electrodes 2 and 3 of the electron-emitting device of the embodiment 3 while applying anode voltage of 1 kV in the vacuum device of FIG. 5 and the device current If and the emission current Ie flowing at this time were measured, it was found that If was 1.0 mA and Ie was 5.3 μA and that the stable electron-emitting property was maintained for a long term.

Lastly, when the electron-emitting device of the embodiment 3 was cut and a cut section near the gap 5 was observed by an electronic microscope of permeable type (TEM), it was found configuration similar to that shown in FIG. 3C was ascertained.

[Embodiment 4]

The electron-emitting device according to an embodiment 4 fundamentally has a configuration similar to that of the electron-emitting devices of the aforementioned embodiments.

A quartz glass substrate was used as the substrate 1, and the substrate was fully cleaned by using pure water, organic solvent and the like. Thereafter, the device electrodes 2, 3 made of ITO were formed on the substrate 1. In this case, a distance L between the device electrodes was selected to 10 μm, a width of the device electrode was selected to 500 μm and a thickness of the device electrode was selected to 100 μm.

Similar to the embodiment 1, the polymer film 4 comprised of polyimide film was formed on the substrate manufactured in this way.

Then, the substrate 1 on which the device electrodes 2, 3 comprised of ITO and the polymer film 4 comprised of polyimide film were formed was set on a stage (under atmospheric pressure), and second high harmonic wave (SHG: wavelength of 632 nm) of Q switch pulse Nd:YAG laser (having pulse width of 100 nm, repeating frequency of 10 kHz, energy of 0.5 mJ (per pulse) and beam diameter of 10 μm) was illuminated onto the polymer film 4. In this case, the second high harmonic wave was illuminated onto the polymer film 4 with a width of 10 μm along a direction directing from the device electrode 2 to the device electrode 3. Further, the resistance between the device electrodes 2 and 3 was measured, and, when the resistance was reduced up to 10 kΩ, the electron beam illumination was stopped.

Here, when the device was picked up and was observed by an electronic microscope of permeable type (TEM), it was found configuration similar to that shown in FIG. 4A was ascertained.

Then, similar to the embodiment 1, by using the system of FIG. 5 and by applying bipolar rectangular pulses having voltage of 25 V, pulse width of 1 msec and pulse interval of 10 msec between the device electrodes 2 and 3, the gap 5 was formed in the polymer film 4, thereby manufacturing the electron-emitting device of the embodiment 4.

Then, when the drive voltage of 22 V was applied between the device electrodes 2 and 3 of the electron-emitting device of the embodiment 4 while applying anode voltage of 1 kV in the vacuum device of FIG. 5 and the device current If and the emission current Ie flowing at this time were measured, it was found that If was 0.8 mA and Ie was 4.2 μA and that the stable electron-emitting property was maintained for a long term.

Lastly, when the electron-emitting device of the embodiment 4 was observed by an electronic microscope of permeable type (TEM), it was found configuration similar to that shown in FIG. 4C was ascertained.

[Embodiment 5]

In an example 5, an electron source in which the electron-emitting devices according to the present invention were arranged in a matrix pattern and an image-forming apparatus were manufactured.

Figure 6A:
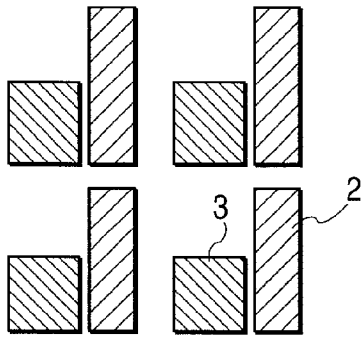
FIGS. 6A, 6B, 6C, 6D and 6E are schematic views showing an example of steps for manufacturing an electron source having passive matrix arrangement.
Figure 6B:
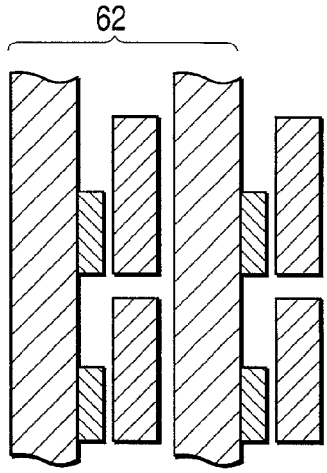
Figure 6C:
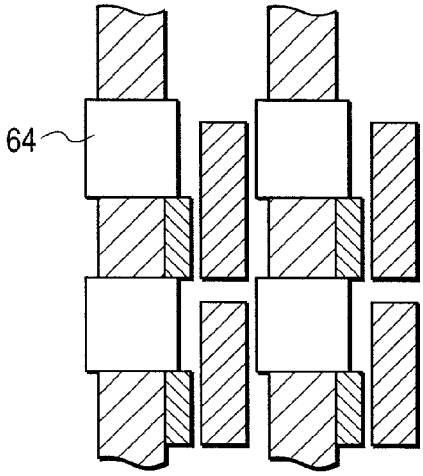
Figure 6D:
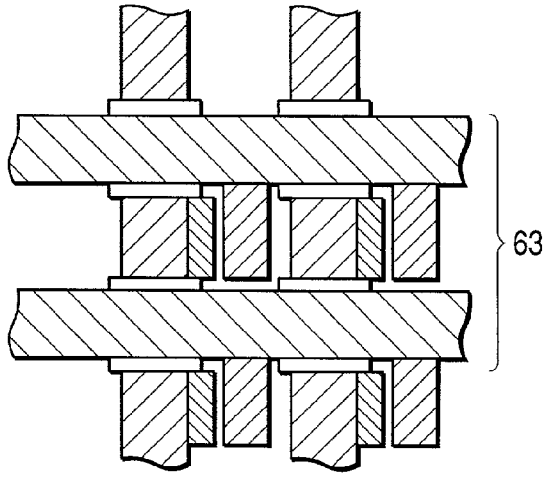
Figure 6E:
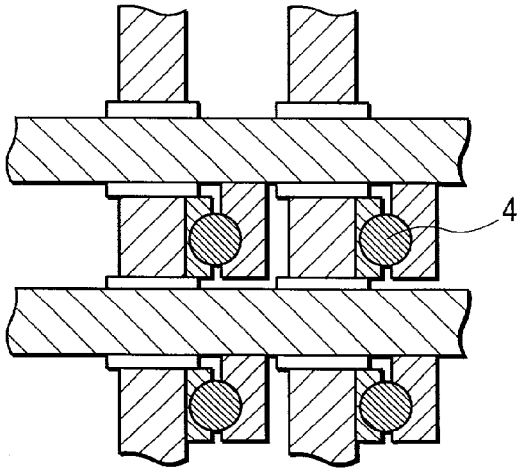
Figure 7:
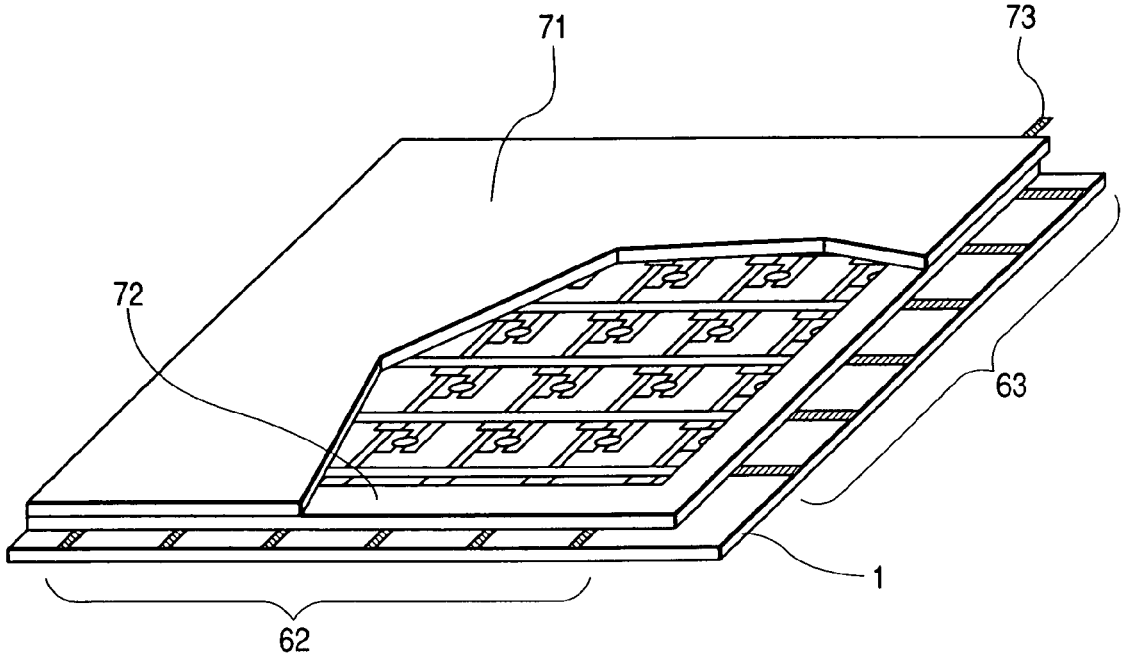
FIG. 7 is a schematic view showing an example of a display panel of an image-forming apparatus having passive matrix arrangement and manufactured by a method according to the present invention.
Figure 8:
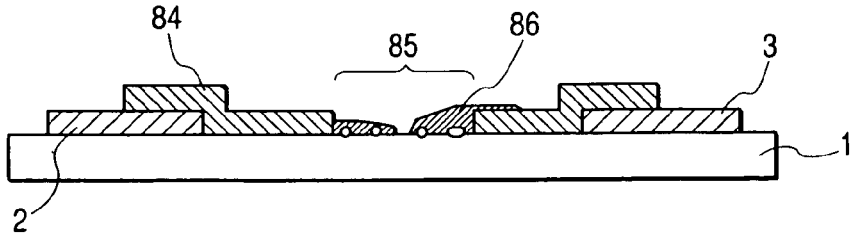
FIG. 8 PRIOR ART
FIG. 8 is a schematic sectional view of a conventional electron-emitting device.

FIGS. 6A to 6E are schematic views for explaining steps for manufacturing the electron source of the embodiment 5 and FIG. 7 is a schematic view showing the image-forming apparatus of the embodiment 5.

FIGS. 6A to 6E show a part of the electron source of the embodiment 5 in an enlarged scale, and the same elements as those in FIGS. 1A and 1B are designated by the same reference numerals. The reference numeral 62 denotes X-direction wiring; 63 denotes Y-direction wiring; and 64 denotes an insulator layer between layers. Incidentally, in FIGS. 6A to 6E, the substrate 1 is omitted from illustration.

In FIG. 7, the same elements as those in FIGS. 1A and 1B and FIGS. 6A to 6E are designated by the same reference numerals. The reference numeral 71 denotes a face plate in which a fluorescent film and Al metal back are laminated on a substrate; 72 denotes a support frame for adhering the face plate 71 to the substrate 1; and 73 denotes a high voltage terminal. The substrate 1, face plate 71 and support frame 72 constitutes a vacuum closed container.

Now, the embodiment 5 will be described with reference to FIGS. 6A to 6E and FIG. 7.

An ITO film having a thickness of 100 nm was deposited on a glass substrate having high strain point (manufactured by Asahi Glass Co., Ltd.; PD200: softening point of 830° C., annealing point of 620° C., strain point of 570° C.) by a spattering method, and the device electrodes 2, 3 comprised of ITO film were formed by using a photolithography technique (FIG. 6A). A distance between the device electrodes 2 and 3 was selected to 10 μm.

Then, Ag paste was printed by a screen printing technique, and the X-direction wiring 62 was formed by heat baking (FIG. 6B).

Then, an insulation paste was printed at a position corresponding to a junction between the X-direction wiring 62 and Y-direction wiring 63 by a screen printing method, and the insulation layer 64 was formed by heat backing (FIG. 6C).

Further, Ag paste was printed by a screen printing method, and Y-direction wiring 63 was formed by heat baking, thereby forming matrix wiring on the substrate 1 (FIG. 6D).

At a position straddling the device electrodes 2 and 3 of the substrate 1 on which the matrix wiring was formed, N-methyl pyrrolidone/triethanol amine solution of 3% of polyamic acid as precursor for polyimide was coated around a center between the device electrodes. This was baked at a temperature of 350° C. under vacuum, thereby obtaining polymer films 4 comprised of a circular polyimide film having diameter of about 100 μm and a thickness of 300 nm (FIG. 6E).

Then, the substrate 1 on which the device electrodes 2, 3 comprised of ITO, matrix wirings 62, 63 and polymer film 4 comprised of polyimide film were formed was set on a stage (under atmospheric pressure), and second high harmonic wave (SHG) of Q switch pulse Nd:YAG laser (having pulse width of 100 nm, repeating frequency of 10 kHz, energy of 0.5 mJ (per pulse) and beam diameter of 10 μm) was illuminated onto the respective polymer films 4. In this case, the second high harmonic wave was illuminated onto the polymer films 4 with a width of 10 μm along a direction directing from the device electrode 2 to the device electrode 3 thereby to form conductive areas having progressed pyrolysis on parts of the polymer films 4.

The substrate 1 manufactured in this way and the face plate 71 were opposed to each other (surfaces on which the fluorescent film and the metal back were formed were opposed to each other) and were arranged via the support frame 72, and seal bonding was effected by using frit glass at a temperature of 400° C. Incidentally, a film on which three colors (RGB; red, green, blue) were arranged in a stripe pattern was used as the fluorescent film.

Air was discharged from the interior of the closed container constituted by the substrate 1, face plate 71 and support frame 72 by means of a vacuum pump through a discharge tube (not shown), and, further, in order to maintain the vacuum, after heating operation of a non-evaporating getter (not shown) (activation operation of getter) was effected within the closed container, the container was sealed by welding the discharge tube by a gas burner.

Lastly, the gaps 5 were formed in the polymer films 4 by applying bipolar rectangular pulses having voltage of 25 V, pulse width of 1 msec and pulse interval of 10 msec between the device electrodes 2 and 3 through the X-direction wiring and the Y-direction wiring, thereby manufacturing the electron source and the image-forming apparatus of the embodiment 5.

In the image-forming apparatus completed in this way, when voltage of 22 V was applied to the selected desired electron-emitting device through the X-direction wiring and the Y-direction wiring and voltage of 8 kV was applied to the metal back through the high voltage terminal 73, it was found that a good bright image could be formed for a long term.

[Embodiment 6]

In an embodiment 6, in place of the electron beam of the embodiment 1, xenon light was illuminated to form the electron-emitting device under the same condition except for the xenon light illumination.

The xenon light illumination in the embodiment 6 was effected as follows.

The substrate 1 on which the device electrodes 2, 3 and the polymer film 4 were formed in the same manner as the embodiment 1 was set on a stage (under atmospheric pressure), and the xenon light was illuminated onto the polymer film 4 to reform a part of the polymer film 4, thereby forming a conductive area having progressed pyrolysis.

The xenon lamp as the light source had 1.5 W (rated). Although wavelength of the light includes bands from visual area to infrared area substantially continuously, particularly, the light has strong light emitting intensity in the near-infrared band in the vicinity of wavelength of 800 nm to 1 μm. Incidentally, although the polymer film used in the embodiment 6 can absorb the light throughout a wide wavelength band from the visual area to the infrared area, particularly, the film has a higher absorbing property in the vicinity of the infrared band.

The light emitted from the light source was collected by a paraboloidal reflector disposed behind the light source and was incident on a light guide comprised of a bundle of optical fibers. The light at an input end has about 400 W or less. Further, the light was guided on the stage through the light guide, and, further, the light is collected to achieve a diameter of 5 mm by a collective lens attached to a distal end of the light guide to illuminate it onto a rear plate.

In this case, a shutter was provided at an incident end of the light guide so that the light was pulse-modulated by opening and closing the shutter at a predetermined interval. The pulse modulating condition was set to open time period of 100 ms and close time period of 200 ms. The optimum light power and pulse condition must be adjusted in dependence upon the material of the polymer film, material of the electrode and configuration.

The illuminated light was directly absorbed by the polymer film to increase the temperature of the polymer film, and the electrodes were warmed by the light illuminated on the electrodes near the polymer film, and heat conduction from the electrodes increased the temperature of the polymer film. In this way, the polymer film was heated.

In this case, voltage of 1 V was applied between the device electrodes 2, 3 and the resistance was monitored, and, when change in resistance becomes small, the light illumination was stopped. It was found the required illumination time was about 2 minutes.

Incidentally, when a halogen lamp is used as the light source, the similar effect can be obtained. However, since a light absorbing property of the polymer film differs from that of the electrode, the pulse applying condition must be set in accordance with the properties.

Similar to the embodiment 1, also in the electron-emitting device of the embodiment 6 manufactured in this way, stable electron-emitting property could be maintained for a long term.

According to the electron-emitting device of the present invention, the electron emission can be effected with high efficiency for a long term, and, in the manufacturing process therefor, since the number of film forming steps can be reduced to one, the process can be simplified to reduce the cost.

Furthermore, the electron source in which a plurality of electron-emitting devices are arranged or the image-forming apparatus can be manufactured by utilizing the electron-emitting devices and manufacturing method therefor according to the present invention, and the image-forming apparatus in which a good bright image having a large area can be displayed for a long term can be realized.

What is claimed is:

1. A method for manufacturing an electron-emitting device, comprising:

a step for forming a solid-state insulating polymer film including a carbon atomic bond between a pair of electrodes formed on a substrate;

a step for heating said polymer film to change said polymer film into an electro-conductive film; and a step for providing a potential difference between said pair of electrodes to energize electrically the electro-conductive film, wherein the step for providing the potential difference is conducted after the step for heating said polymer film.

2. A method according to claim 1, wherein the step for heating includes a step for illuminating an electron beam onto at least a part of said polymer film.

3. A method according to claim 1, wherein the step for heating includes a step for illuminating light onto at least a part of said polymer film.

4. A method according to claim 3, wherein the light is light emitted from a xenon lamp as a light source.

5. A method according to claim 3, wherein the light is light emitted from a halogen lamp as a light source.

6. A method according to claim 3, wherein the light is a laser beam.

7. A method according to claim 1, wherein said polymer film is an aromatic polymer film.

8. A method according to claim 1, wherein the step for forming a polymer film utilizes an ink jet system.

9. A method for manufacturing an electron source having a plurality of electron-emitting devices, wherein:

each electron-emitting device is manufactured in accordance with the method according to claim 1.

10. A method for manufacturing an image-forming apparatus having an electron source including a plurality of electron-emitting devices, and an image-forming member for forming an image by illumination of electron emitted from said electron source, wherein:

said electron source is manufactured by a method according to claim 9.

11. A method for manufacturing an electron-emitting device, comprising:

a step for forming a polymer film including a carbon atomic bond between a pair of electrodes formed on a substrate;

a step for illuminating an electron beam onto at least a part of said polymer film; and a step for providing a potential difference between said pair of electrodes;

wherein the step for providing the potential difference is conducted after the step for illuminating the electron beam.

12. A method according to claim 11, wherein the step for illuminating the electron beam onto said polymer film includes a step for giving conductivity to at least a part of said polymer film.

13. A method according to claim 11, wherein the step for illuminating the electron beam onto said polymer film includes a step for reducing electrical resistance of said polymer film.

14. A method according to claim 11, wherein said polymer film is an aromatic polymer film.

15. A method according to claim 11, wherein the step for forming a polymer film utilizes an ink jet system.

16. A method for manufacturing an electron source having a plurality of electron-emitting devices, wherein each electron-emitting device is manufactured in accordance with the method according to 11.

17. A method for manufacturing an image-forming apparatus having an electron source including a plurality of electron-emitting devices, and an image-forming member for forming an image by illumination of electron emitted from said electron source, wherein said electron source is manufactured by a method according to claim 16.

18. A method for manufacturing an electron-emitting device, comprising:

a step for forming a polymer film including a carbon atomic bond between a pair of electrodes formed on a substrate;

a step for illuminating light onto at least a part of said polymer film; and a step for providing a potential difference between said pair of electrodes, wherein the step for providing the potential difference is conducted after the step for illuminating light.

19. A method according to claim 18, wherein the step for illuminating light onto said polymer film includes a step for giving conductivity to at least a part of said polymer film.

20. A method according to claim 18, wherein the step for illuminating light onto said polymer film includes a step for reducing electrical resistance of said polymer film.

21. A method according to claim 20, wherein the light is light emitted from a xenon lamp as a light source.

22. A method according to claim 20, wherein the light is light emitted from a halogen lamp as a light source.

23. A method according to claim 20, wherein the light is a laser beam.

24. A method according to claim 18, wherein said polymer film is an aromatic polymer film.

25. A method according to claim 18, wherein the step for forming a polymer film utilizes an ink jet system.

26. A method for manufacturing an electron source having a plurality of electron-emitting devices, wherein each electron-emitting device is manufactured in accordance with the method according to 18.

27. A method for manufacturing an image-forming apparatus having an electron source including a plurality of electron-emitting devices, and an image-forming member for forming an image by illumination of electron emitted from said electron source, wherein said electron source is manufactured by a method according to claim 26.

* * * * *

UNITED STATES PATENT AND TRADEMARK OFFICE

CERTIFICATE OF CORRECTION

PATENT NO. : 7,335,081 B2
APPLICATION NO. : 09/941782
DATED : February 26, 2008
INVENTOR(S) : Takashi Iwaki et al.

It is certified that error appears in the above-identified patent and that said Letters Patent is hereby corrected as shown below:

COLUMN 5:

Line 54, “is” should read --are--.

COLUMN 6:

Line 23, “as” should read --an--; and
Line 58, “effectively” should read --effective--.

COLUMN 7:

Line 13, “occur” should read --produce--;
Line 25, close up right margin;
Line 26, close up left margin; and
Line 28, “quarts” should read --quartz--.

COLUMN 9:

Line 25, “cases,” should read --case,--;
Line 48, “polymer film 4” should read --polymer film 4,--; and
Line 57, “and” should be deleted.

COLUMN 14:

Line 28, “constitutes” should read --constitute--.

UNITED STATES PATENT AND TRADEMARK OFFICE

CERTIFICATE OF CORRECTION

PATENT NO. : 7,335,081 B2
APPLICATION NO. : 09/941782
DATED : February 26, 2008
INVENTOR(S) : Takashi Iwaki et al.

It is certified that error appears in the above-identified patent and that said Letters Patent is hereby corrected as shown below:

COLUMN 16:

Line 17, "becomes" should read --became--.

Signed and Sealed this

Thirtieth Day of September, 2008

JON W. DUDAS
*Director of the United States Patent and Trademark Office*